US005137600A

United States Patent [19]

Barnes et al.

[11] Patent Number: 5,137,600

[45] Date of Patent: Aug. 11, 1992

[54] HYDRAULICALLY NEEDLED NONWOVEN PULP FIBER WEB

[75] Inventors: Harold K. Barnes, Augusta; Ronald F. Cook, Marietta; Cherie H. Everhart, Alpharetta; Ann L. McCormack, Cumming; Fred R. Radwanski, Roswell, all of Ga.; Paulette M. Rosch, Appleton, Wis.; Adrian J. Trevisan, Marietta, Ga.

[73] Assignee: Kimberley-Clark Corporation, Neenah, Wis.

[21] Appl. No.: 608,095

[22] Filed: Nov. 1, 1990

[51] Int. Cl.[5] ..... D04H 1/46; D21H 25/04; D21H 27/00

[52] U.S. Cl. ..... 162/115; 28/105; 428/120; 428/311.1; 428/311.5; 428/311.7

[58] Field of Search ..... 162/115; 28/105; 428/311.1, 311.5, 311.7, 120

[56] References Cited

U.S. PATENT DOCUMENTS

| | | | |
|---|---|---|---|
| 2,666.369 | 1/1954 | Niks | 92/38 |
| 3,042,576 | 7/1962 | Harmon et al. | 162/114 |
| 3,081,500 | 3/1963 | Griswold et al. | 19/161 |
| 3,081,515 | 3/1963 | Griswold et al. | 28/78 |
| 3,220,914 | 11/1965 | Boadway et al. | 161/128 |
| 3,284,857 | 11/1966 | Hynek | 19/161 |
| 3,471,907 | 10/1969 | Beckers | 26/18.6 |
| 3,477,906 | 11/1969 | Rabstad | 162/205 |
| 3,486,706 | 12/1969 | Evans | 161/72 |
| 3,498,874 | 3/1970 | Evans et al. | 161/109 |
| 3,565,756 | 2/1971 | Kashiwabara et al. | 162/297 |
| 3,750,237 | 8/1973 | Kalwaites | 19/161 P |
| 3,821,068 | 6/1974 | Shaw | 162/111 |
| 4,109,353 | 8/1978 | Mitchell et al. | 28/104 |
| 4,166,877 | 9/1979 | Brandon et al. | 428/221 |
| 4,228,123 | 10/1980 | Marshall | 264/557 |
| 4,329,763 | 5/1982 | Alexander et al. | 28/104 |
| 4,440,597 | 4/1984 | Wells et al. | 162/111 |
| 4,542,060 | 9/1985 | Yoshida et al. | 428/287 |
| 4,623,575 | 11/1986 | Brooks et al. | 428/113 |
| 4,665,957 | 5/1987 | Suzuki et al. | 28/104 |
| 4,693,922 | 9/1987 | Buyofsky et al. | 428/134 |
| 4,695,500 | 9/1987 | Dyer et al. | 428/134 |
| 4,735,842 | 4/1988 | Buyfosky et al. | 428/134 |
| 4,755,421 | 7/1988 | Manning et al. | 428/224 |
| 4,775,421 | 7/1988 | Manning et al. | 428/224 |
| 4,810,568 | 3/1989 | Buyofsky et al. | 428/284 |
| 4,883,709 | 11/1989 | Nozaki et al. | 428/288 |
| 4,920,001 | 4/1990 | Lee et al. | 428/289 |
| 4,931,355 | 6/1990 | Radwanski et al. | 428/283 |
| 5,009,747 | 4/1991 | Viazmensky et al. | 162/115 |

FOREIGN PATENT DOCUMENTS

| | | |
|---|---|---|
| 841938 | 5/1970 | Canada . |
| 128667 | 12/1984 | European Pat. Off. . |
| 308320A | 3/1989 | European Pat. Off. . |
| 333228A | 9/1989 | European Pat. Off. . |
| 411752 | 6/1991 | European Pat. Off. . |
| 1212473 | 11/1970 | United Kingdom . |

OTHER PUBLICATIONS

J.P. Abstract, 2,080,699-A2, Mar. 20, 1990, Sanyo Kokusaku Pulp.

Aspects of Jetlace Technology As Applied To Wet--Laid Non-Wovens; Nonwovens Conference—Nov., 1987.

Wipes For Hydroentanglement Systems;—Nonwoven Fabrics Forum; Jun. 1988.

Hydroentanglement Technology Applied To Wet--Formed And Other Precursor Webs; TAPPI Journal; Jun. 1990.

*Primary Examiner*—James C. Cannon

*Attorney, Agent, or Firm*—Karl V. Sidor

[57] ABSTRACT

A hydraulically needled nonwoven pulp fiber web is disclosed. This nonwoven pulp fiber web has a mean flow pore size ranging from about 18 to about 100 microns, and a Frazier porosity of at least about 100 cfm/ft$^2$. The web may also be characterized by a specific volume ranging from about 8 to about 15 cm$^3$/g. The nonwoven pulp fiber web may contain a significant proportion of low-average fiber length pulp and still have a total absorptive capacity greater than about 500 percent and a wicking rate greater than about 2 centimeters per 15 seconds. The hydraulically needled nonwoven pulp fiber web may be used as a hand towel, wipe, or as a fluid distribution material in an absorbent personal care product. Also disclosed is a method of making the hydraulically needled nonwoven pulp fiber web.

33 Claims, 11 Drawing Sheets

HYDRAULICALLY NEEDLED NONWOVEN PULP FIBER WEB

FIELD OF THE INVENTION

The present invention relates to a nonwoven pulp fiber web which may be used as an absorbent hand towel or wiper or as a fluid distribution material in absorbent personal care products. This invention also relates to a method for making a nonwoven pulp fiber web.

BACKGROUND OF THE INVENTION

Absorbent nonwoven pulp fiber webs have long been used as practical and convenient disposable hand towels or wipes. These nonwoven webs are typically manufactured in conventional high speed papermaking processes having additional post-treatment steps designed to increase the absorbency of the paper sheet. Exemplary post-treatment steps include creping, aperturing, and embossing. These post-treatment steps as well as certain additives (e.g., debonding agents) generally appear to enhance absorbency by loosening the compact fiber network found in most types of nonwoven pulp fiber webs, especially those webs made from low-average fiber length pulp such as, for example, secondary (i.e., recycled) fiber pulp.

Some highly absorbent single ply and multiple-ply absorbent hand towels or wipes are made using the conventional methods described above. Those materials, which may be capable of absorbing up to about 5 times their weight of water or aqueous liquid, are typically made from high-average fiber length virgin softwood pulp. Low-average fiber length pulps typically do not yield highly absorbent hand towels or wipes While a loosened network of pulp fibers is generally associated with good absorbency in nonwoven pulp fiber webs, such a loose fiber network may reduce the rate which the nonwoven pulp fiber web absorbs and/or wicks liquids.

Water jet entanglement has been disclosed as having a positive effect on the absorbency of a nonwoven wood pulp fiber web. For example, Canadian Patent No. 841,398 to Shambelan discloses that high pressure jet streams of water may be used to produce a paper sheet having a highly entangled fiber structure with greater toughness, flexibility, and extensibility, abrasion resistance, and absorbency than the untreated starting paper. The fabrics are prepared by treating a paper sheet with jet streams of water until a stream energy of 0.05 to 2.0 horsepower-hours per pound of product has been applied in order to create a highly entangled fiber structure characterized by a considerable proportion of fiber segments aligned transversely to the plane of the fabric. According to Shambelan, these fabrics are characterized by a density of less than 0.3 grams/cm$^3$, a strip tensile strength of at least 0.7 pounds/inch per yd$^2$, and an elongation-at-break of at least 10% in all directions. It is disclosed that the entangled fiber structure may be formed from any fibers previously used in papermaking as well as blends of staple length fibers and wood pulp fibers.

A paper entitled "Aspects of Jetlace Technology as Applied to Wet-Laid Non-Wovens" by Audre Vuillaume and presented at the Nonwovens in Medical & Healthcare Applications Conference (November 1987) teaches that in order to successfully entangle short fibers like wood pulp fibers it is necessary to add long fibers (e.g., staple length fibers) to create a coherent web structure. The addition of 25 to 30% long fiber is recommended. The paper also recommends utilizing jets of water at less than conventional pressures to entangle the fibers because high-pressure jets of water would destroy or damage the web and/or cause unacceptable fiber loss.

An exemplary wet-laid nonwoven fibrous web which is hydraulically entangled at reduced entangling energies is disclosed in U.S. Pat. No. 4,755,421 to Manning, et al. That patent describes a wet-wipe formed from a wet-laid web containing wood pulp fibers and at least 5 percent, by weight, staple length regenerated cellulose fibers. The web is treated with jet streams of water until a stream energy of 0.07 to 0.09 horsepower-hours per pound of product is applied. The treated web is disclosed as having high wet tensile strength when packed in a preservative liquid yet is able to break up under mild agitation in a wet environment. According to Manning, et al., the breakup time and wet tensile strength is proportional to the entangling energy. That is, as entangling energy is reduced, the wet tensile strength and the break-up time are reduced.

While these references are of interest to those practicing water-jet entanglement of fibrous materials, they do not address the need for a water jet treatment which opens up or loosens a compact network of pulp fibers to produce a highly absorbent nonwoven web which may be used as a disposable hand towel or wipe or as a fluid distribution material in a personal care product. There is still a need for an inexpensive nonwoven pulp fiber web which is able to quickly absorb several times its weight in water or aqueous liquid. There is also a need for a nonwoven pulp fiber web which contains a substantial proportion of low-average fiber length pulp and which is able to quickly absorb several times its weight in water or aqueous liquid. There is also a need for a practical method of making a highly absorbent pulp fiber web. This need also extends to a method of making such a web which contains a substantial proportion of low-average fiber length pulp. Meeting this need is important since it is both economically and environmentally desirable to substitute low-average fiber length secondary (i.e., recycled) fiber pulp for high-quality virgin wood fiber pulp still provide a highly absorbent nonwoven pulp fiber web.

DEFINITIONS

The term "machine direction" as used herein refers to the direction of travel of the forming surface onto which fibers are deposited during formation of an absorbent nonwoven web.

The term "cross-machine direction" as used herein refers to the direction which is perpendicular to the machine direction defined above.

The term "pulp" as used herein refers to pulp containing fibers from natural sources such as woody and non-woody plants. Woody plants include, for example, deciduous and coniferous trees. Non-woody plants include, for example, cotton, flax, esparto grass, milkweed, straw, jute hemp, and bagasse.

The term "average fiber length" as used herein refers to a weighted average length of pulp fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{X_i=0}^{k} (X_i * n_i)/n$$

where

K=maximum fiber length $x_i$=fiber length $n_i$=number of fibers having length $x_i$ n=total number of fibers measured.

The term "low-average fiber length pulp" as used herein refers to pulp that contains a significant amount of short fibers and non-fiber particles which may yield relatively tight, impermeable paper sheets or nonwoven webs that are less desirable in applications where absorbency and rapid fluid intake are important. Many secondary wood fiber pulps may be considered low average fiber length pulps; however, the quality of the secondary wood fiber pulp will depend on the quality of the recycled fibers and the type and amount of previous processing. Low-average fiber length pulps may have an average fiber length of less than about 1.2 mm as determined by an optical fiber analyzer such as, for example, a Kajaani fiber analyzer model No. FS-100 (Kajaani Oy Electronics, Kajaani, Finland). For example, low average fiber length pulps may have an average fiber length ranging from about 0.7 to 1.2 mm. Exemplary low average fiber length pulps include virgin hardwood pulp, and secondary fiber pulp from sources such as, for example, office waste, newsprint, and paperboard scrap.

The term "high-average fiber length pulp" as used herein refers to pulp that contains a relatively small amount of short fibers and non-fiber particles which may yield relatively open, permeable paper sheets or nonwoven webs that are desirable in applications where absorbency and rapid fluid intake are important. High-average fiber length pulp is typically formed from non-secondary (i.e., virgin) fibers. Secondary fiber pulp which has been screened may also have a high-average fiber length. High-average fiber length pulps typically have an average fiber length of greater than about 1.5 mm as determined by an optical fiber analyzer such as, for example, a Kajaani fiber analyzer model No. FS-100 (Kajaani Oy Electronics, Kajaani, Finland). For example, a high-average fiber length pulp may have an average fiber length from about 1.5 mm to about 6 mm. Exemplary high-average fiber length pulps which are wood fiber pulps include, for example, bleached and unbleached virgin softwood fiber pulps.

The term "total absorptive capacity" as used herein refers to the capacity of a material to absorb liquid (i.e., water or aqueous solution) over a period of time and is related to the total amount of liquid held by a material at its point of saturation. Total absorptive capacity is determined by measuring the increase in the weight of a material sample resulting from the absorption of a liquid. The general procedure used to measure the absorptive capacity conforms to Federal Specification No. UU-T-595C and may be expressed, in percent, as the weight of liquid absorbed divided by the weight of the sample by the following equation:

Total Absorptive Capacity=[(saturated sample weight—sample weight)/sample weight]×100.

The terms "water rate" as used herein refers to the rate at which a drop of water is absorbed by a flat, level sample of material. The water rate was determined in accordance with TAPPI Standard Method T432-SU-72 with the following changes: 1) three separate drops are timed on each sample; and 2) five samples are tested instead of ten.

The term "wicking rate" as used herein refers to the rate which water is drawn in the vertical direction by a strip of an absorbent material. The wicking rate was determined in accordance with American Converters Test EP-SAP-41.01.

The term "porosity" as used herein refers to the ability of a fluid, such as, for example, a gas to pass through a material. Porosity may be expressed in units of volume per unit time per unit area, for example, (cubic feet per minute) per square foot of material (e.g., ($ft^3$/minute/$ft^2$) or (cfm/$ft^2$)). The porosity was determined utilizing a Frazier Air Permeability Tester available from the Frazier Precision Instrument Company and measured in accordance with Federal Test Method 5450, Standard No. 191A, except that the sample size was 8"×8"instead of 7"×7".

The term "bulk density" as used herein refers to the weight of a material per unit of volume. Bulk density is generally expressed in units of weight/volume (e.g., grams per cubic centimeter). The bulk density of flat, generally planar materials such as, for example, fibrous nonwoven webs, may be derived from measurements of thickness and basis weight of a sample. The thickness of the samples is determined utilizing a Model 49-70 thickness tester available from TMI (Testing Machines Incorporated) of Amityville, New York. The thickness was measured using a 2-inch diameter circular foot at an applied pressure of about 0.2 pounds per square inch (psi). The basis weight of the sample was determined essentially in accordance with ASTM D-3776-9 with the following changes: 1) sample size was 4 inches ×4 inches square; and 2) a total of 9 samples were weighed.

The term "specific volume" as used herein refers to the inverse bulk density volume of material per a unit weight of and may be expressed in units of cubic centimeters per gram.

The term "mean flow pore size" as used herein refers to a measure of average pore diameter as determined by a liquid displacement techniques utilizing a Coulter Porometer and Coulter POROFIL TM test liquid available from Coulter Electronics Limited, Luton, England. The mean flow pore size is determined by wetting a test sample with a liquid having a very low surface tension (i.e., Coulter POROFIL TM). Air pressure is applied to one side of the sample. Eventually, as the air pressure is increased, the capillary attraction of the fluid in the largest pores is overcome, forcing the liquid out and allowing air to pass through the sample. With further increases in the air pressure, progressively smaller and smaller holes will clear. A flow versus pressure relationship for the wet sample can be established and compared to the results for the dry sample. The mean flow pore size is measured at the point where the curve representing 50% of the dry sample flow versus pressure intersects the curve representing wet sample flow versus pressure. The diameter of the pore which opens at that particular pressure (i.e., the mean flow pore size) can be determined from the following expression:

$$\text{Pore Diameter } (\mu m) = (40\tau)/\text{pressure}$$

where $\tau$ = surface tension of the fluid expressed in units of mN/M; the pressure is the applied pressure expressed in millibars (mbar); and the very low surface tension of the liquid used to wet the sample allows one to assume that the contact angle of the liquid on the sample is about zero.

SUMMARY OF THE INVENTION

The present invention addresses the needs discussed above by providing a nonwoven pulp fiber web in which the pulp fibers define pores having a mean flow pore size ranging from about 15 to about 100 microns and in which the nonwoven web has a porosity of at least about 100 $ft^3$/minute/$ft^2$. The nonwoven pulp fiber web also has a specific volume of at least about 7 $cm^3$/g, a total absorptive capacity greater than about 500 percent and a wicking rate greater than about 2 cm per 15 seconds.

In one embodiment, the pulp fibers may define pores having a mean flow pore size ranging from about 20 to about 40 microns. The porosity of that nonwoven pulp fiber web may range from about 100 to about 200 $ft^3$/minute/$ft^2$ and the specific volume may range from about 10 to about 15 $cm^3$/g. The nonwoven web may also have a total absorptive capacity between about 500 and about 750 percent and a wicking rate between about 2 to about 3 cm per 15 seconds.

The nonwoven web is made of pulp fibers. The pulp may be a mixture of different types and/or qualities of pulp fibers. For example, one embodiment of the invention is a nonwoven web containing more than about 50% by weight, low-average fiber length pulp and less than about 50% by weight, high-average fiber length pulp (e.g., virgin softwood pulp). The low-average fiber length pulp may be characterized as having an average fiber length of less than about 1.2 mm. For example, the low-average fiber length pulp may have a fiber length from about 0.7 mm to about 1.2 mm. The high-average fiber length pulp may be characterized as having an average fiber length of greater than about 1.5 mm. For example, the high-average fiber length pulp may have an average fiber length from about 1.5 mm to about 6 mm. One exemplary fiber mixture contains about 75 percent, by weight, low-average fiber length pulp and about 25 percent, by weight, high-average fiber length pulp.

According to the invention, the low-average fiber length pulp may be certain grades of virgin hardwood pulp and low-quality secondary (i.e., recycled) fiber pulp from sources such as, for example, newsprint, reclaimed paperboard, and office waste. The high-average fiber length pulp may be bleached and unbleached virgin softwood pulps.

The present invention also contemplates treating the nonwoven pulp fiber web with additives such as, for example, binders, surfactants, cross-linking agents, hydrating agents and/or pigments to impart desirable properties such as, for example, abrasion resistance, toughness, color, or improved wetting ability. Alternatively and/or additionally, the present invention contemplates adding particulates such as, for example, activated charcoal, clays, starches, and hydrocolloid particles commonly referred to as superabsorbents to the absorbent nonwoven web.

The nonwoven pulp fiber web may be used as a paper towel or wipe or as a fluid distribution material in an absorbent personal care product. In one embodiment, the nonwoven web may be a hand towel or wiper having a basis weight from about 18 to about 120 grams per square meter (gsm). For example, the paper towel may have a basis weight between about 20 to about 70 gsm or more particularly, from about 30 to about 60 gsm. The hand towel or wiper desirably has a mean flow pore size ranging from about 15 to about 100 microns, a specific volume of about 12 $cm^3$/g, a total absorptive capacity greater than about 500 percent, a wicking rate greater than about 2.0 cm per 15 seconds, and a Frazier porosity greater than about 100 $ft^3$/minute/$ft^2$. The hand towel or wiper may be a single ply or multi-ply material. When used as a fluid management material in a personal care product, the absorbent nonwoven web may have about the same properties as the hand towel or wiper embodiment except for a basis weight which may range from about 7 to about 70 gsm. One or more layers of the nonwoven pulp fiber web may also be used as an absorbent component of a personal care product. The multiple layers may have a combined basis weight of 100 gsm or more.

The present invention also contemplates a method of making an absorbent, nonwoven web by forming a wet-laid nonwoven web of pulp fibers; hydraulically needling the wet-laid nonwoven web of fibers on a foraminous surface at an energy level less than about 0.03 horsepower-hours/pound of dry web; and drying the hydraulically needled nonwoven structure of wet-laid pulp fibers utilizing one or more non-compressive drying processes. In one aspect of the invention, a pulp sheet may be rehydrated and subjected to hydraulic needling.

The wet-laid nonwoven web is formed utilizing conventional wet-laying techniques. The nonwoven web may be formed and hydraulically needled on the same foraminous surface. The foraminous surface may be, for example, a single plane mesh having a mesh size of from about 40×40 to about 100×100. The foraminous surface may also be a multi-ply mesh having a mesh size from about 50×50 to about 200×200. In one embodiment of the present invention the foraminous surface may have a series of ridges and channels and protruding knuckles which impart certain characteristics to the nonwoven web.

Low pressure jets of a liquid (e.g., water or similar working fluid) are used to produce a desired loosening of the pulp fiber network. It has been found that the nonwoven web of pulp fibers has desired levels of absorbency when jets of water are used to impart a total energy of less than about 0.03 horsepower-hours/pound of web. For example, the energy imparted by the working fluid may be between about 0.002 to about 0.03 horsepower-hours/pound of web.

In another aspect of the method of the present invention, the wet-laid, hydraulically needled nonwoven structure may be dried utilizing a non-compressive drying process. Through-air drying processes have been found to work particularly well. Other drying processes which incorporate infra-red radiation, yankee dryers, steam cans, microwaves, and ultrasonic energy may also be used.

DETAILED DESCRIPTION OF THE INVENTION

Figure 1:
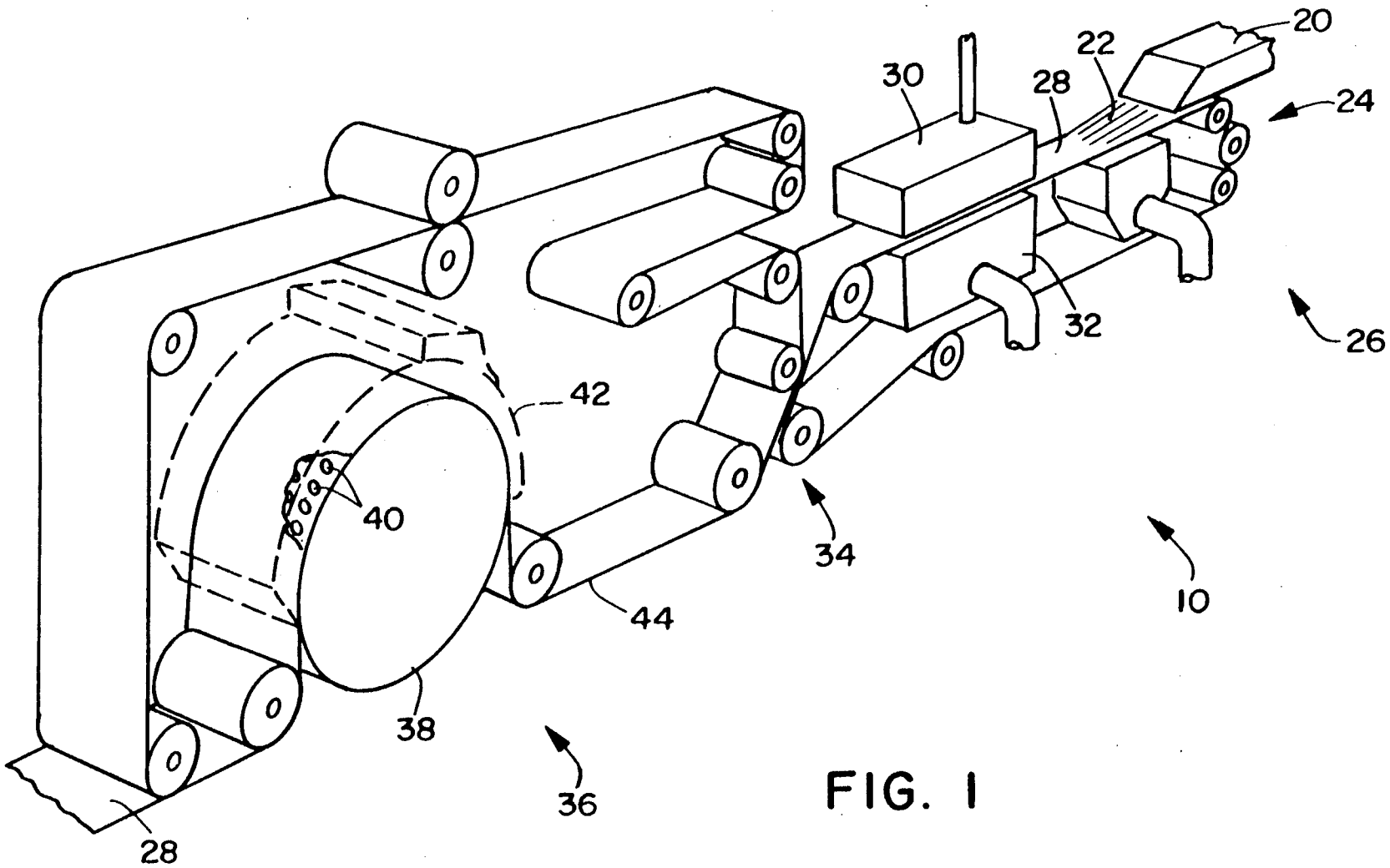
FIG. 1 is an illustration of an exemplary process for making a wet-laid, hydraulically needled nonwoven pulp fiber web.

Referring to FIG. 1 of the drawings there is schematically illustrated at 10 a process for forming a hydraulically needled, wet-laid nonwoven pulp fiber web. According to the present invention, a dilute suspension of pulp fibers is supplied by a headbox 20 and deposited via a sluice 22 in uniform dispersion onto a foraminous screen 24 of a conventional papermaking machine 26. The suspension of pulp fibers may be diluted to any consistency which is typically used in conventional papermaking processes. For example, the suspension may contain from about 0.1 to about 1.5 percent by weight pulp fibers suspended in water.

The pulp fibers may be any high-average fiber length pulp, low-average fiber length pulp, or mixtures of the same. The high-average fiber length pulp typically have an average fiber length from about 1.5 mm to about 6mm. Exemplary high-average fiber length wood pulps include those available from the Kimberly-Clark Corporation under the trade designations Longlac 19, Longlac 16, Coosa River 56, and Coosa River 57.

The low-average fiber length pulp may be, for example, certain virgin hardwood pulps and secondary (i.e. recycled) fiber pulp from sources such as, for example, newsprint, reclaimed paperboard, and office waste. The low- average fiber length pulps typically have an average fiber length of less than about 1.2 mm, for example, from 0.7 mm to 1.2 mm.

Mixtures of high-average fiber length and low-average fiber length pulps may contain a significant proportion of low-average fiber length pulps. For example, mixtures may contain more than about 50 percent by weight low-average fiber length pulp and less than about 50 percent by weight high-average fiber length pulp. One exemplary mixture contains 75 percent by weight low-average fiber length pulp and about 25 percent high-average fiber length pulp.

The pulp fibers used in the present invention may be unrefined or may be beaten to various degrees of refinement. Small amounts of wet-strength resins and/or resin binders may be added to improve strength and abrasion resistance. Useful binders and wet-strength resins include, for example, Kymene 557 H available from the Hercules Chemical Company and Parez 631 available from American Cyanamid, Inc. Cross-linking agents and/or hydrating agents may also be added to the pulp mixture. Debonding agents may be added to the pulp mixture to reduce the degree of hydrogen bonding if a very open or loose nonwoven pulp fiber web is desired. One exemplary debonding agent is available from the Quaker Chemical Company, Conshohocken, Pennsylvania, under the trade designation Quaker 2008.

The suspension of pulp fibers is deposited on the foraminous surface 24 and water is removed to form a uniform nonwoven web of pulp fibers 28. Hydraulic needling may take place on the foraminous surface (i.e., mesh fabric) 24 on which the wet-laid web is formed. Alternatively, the web may be transferred to a different foraminous surface for hydraulic needling. The present invention also contemplates rehydrating a dried pulp sheet to a specified consistency and subjecting the rehydrated pulp sheet to hydraulic needling.

The nonwoven web 28 passes under one or more hydraulic needling manifolds 30 and is treated with jets of fluid to open up or loosen and rearrange the tight network of pulp fibers. The hydraulic needling may take place while the nonwoven web is at a consistency between about 15 to about 45 percent solids. For example, the nonwoven web may be at a consistency from about 25 to about 30 percent solids.

Although the inventors should not be held to a particular theory of operation, it is believed that hydraulic needling at the specified consistencies allows the pulp fibers to be rearranged without interfering with hydrogen bonding since the pulp fibers are maintained in a hydrated state. The specified consistencies also appear to provide optimum pulp fiber mobility. If the consistency is too low, the nonwoven pulp fiber web may be disintegrated by the fluid jets. If the consistency of the web is too high, the fiber mobility decreases and the energy required to move the fibers increases resulting in higher energy fluid jet treatments.

According to the invention, the nonwoven pulp fiber web 28 is hydraulically needled. That is, conventional hydraulic entangling equipment may be operated at low pressures to impart low energies (i.e., 0.002 to 0.03 hp-hr/lb) to the web. Water jet treatment equipment which may be adapted to the low pressure-low energy process of the present invention may be found, for example, in U.S. Pat. No. 3,485,706 to Evans, the disclosure of which is hereby incorporated by reference. The hydraulic needling process of the present invention may be carried out with any appropriate working fluid such as, for example, water. The working fluid flows through a manifold which evenly distributes the fluid to a series of individual holes or orifices. These holes or orifices may be from about 0.003 to about 0.015 inch in diameter. For example, the invention may be practiced utilizing a manifold produced by Honeycomb Systems Incorporated of Biddeford, Maine, containing a strip having 0.007 inch diameter orifices, 30 holes per inch, and 1 row of holes. Many other manifold configurations and combinations may be used. For example, a single manifold may be used or several manifolds may be arranged in succession.

In the hydraulic needling process, the working fluid passes through the orifices at a pressure ranging from about 50 to about 400 pounds per square inch gage (psig) to form fluid streams which impact the wet-laid web 28 with much less energy than typically found in conventional hydraulic entangling processes. For example, when 4 manifolds are used, the fluid pressure may be from about 60 to about 200 psig. Because the streams are at such low pressures, the jet orifices installed in the manifolds 30 are located a very short distance above the nonwoven pulp fiber web 28. For example, the jet orifices may be located about 1 to about 5 cm above the nonwoven web of pulp fibers. As is typical in many water jet treatment processes, vacuum slots 32 may be located directly beneath the hydro-needling manifolds or beneath the foraminous surface 24 downstream of the entangling manifold so that excess water is withdrawn from the hydraulically-needled wet-laid web 28. Although the inventors should not be held to a particular theory of operation, it is believed that the columnar jets of working fluid which directly impact pulp fibers laying in the X-Y plane of nonwoven web work to rearrange some of those fibers into the Z-direction. This is believed to increase the specific volume of the wet-laid nonwoven pulp fiber web. The jets of working fluid also wash the pulp fibers off knuckles, ridges or raised portions of the foraminous surface. This washing action appears to create pores and/or apertures on the raised portions or knuckles of the foraminous surface as well as low density deposits of fibers in channel-like portions of the foraminous surface. The jets of working fluid are also believed to bounce or rebound from the foraminous surface. Although this phenomena appears to be less predominant than the direct impact and/or washing actions of the jets of fluid it is believed to increase the interstitial spaces between the fibers of the nonwoven web. The direct impact, washing action, and rebound effect of the jets, in combination, appear to increase the porosity and mean flow pore size of the wet-laid nonwoven pulp fiber web which is believed to be reflected in greater bulk and increased absorbency characteristics (e.g., total absorptive capacity, wicking rate, water rate).

After fluid jet treatment, the web 28 may then be transferred to a non-compressive drying operation. A differential speed pickup roll 34 may be used to transfer the web from the hydraulic needling belt to a non-compressive drying operation. Alternatively, conventional vacuum-type pickups and transfer fabrics may be used. Non-compressive drying of the web may be accomplished utilizing a conventional rotary drum through-air drying apparatus shown in FIG. 1 at 36. The through-dryer 36 may be an outer rotatable cylinder 38 with perforations 40 in combination with an outer hood 42 for receiving hot air blown through the perforations 40. A through-dryer belt 44 carries the web 28 over the upper portion of the through-dryer outer cylinder 28. The heated air forced through the perforations 40 in the outer cylinder 38 of the through-dryer 36 removes water from the web 28. The temperature of the air forced through the web 28 by the through-dryer 36 may range from about 300° to about 500° F. Other useful through-drying methods and apparatus may be found in, for example, U.S. Pat. Nos. 2,666,369 and 3,821,068, the contents of which are incorporated herein by reference.

It may be desirable to use finishing steps and/or post treatment processes to impart selected properties to the webs 28. For example, the web may be lightly pressed by calender rolls or brushed to provide a uniform exterior appearance and/or certain tactile properties. Alternatively and/or additionally, chemical post-treatments such as, adhesives or dyes may be added to the web.

In one aspect of the invention, the web may contain various materials such as, for example, activated charcoal, clays, starches, and absorbents such as, for example, certain hydrocolloid materials commonly referred to as superabsorbents. For example, these materials may be added to the suspension of pulp fibers used to form the wet-laid nonwoven web. These materials may also be deposited on the web prior to the fluid jet treatments so that they become incorporated into the web by the action of the fluid jets. Alternatively and/or additionally, these materials may be added to the nonwoven web after the fluid jet treatments. If superabsorbent materials are added to the suspension of pulp fibers or to the wet-laid web before water-jet treatments, it is preferred that the superabsorbents are those which can remain inactive during the wet-laying and/or water-jet treatment steps and can be activated later. Conventional superabsorbents may be added to the nonwoven web after the water-jet treatments. Useful superabsorbents include, for example, a sodium polyacrylate superabsorbent available from the Hoechst Celanese Corporation under the trade name Sanwet IM-5000 P. Superabsorbents may be present at a proportion of up to about 50 grams of superabsorbent per 100 grams of pulp fiber web. For example, the nonwoven web may contain from about 15 to about 30 grams of superabsorbent per 100 grams of pulp fibers web. More particularly, the nonwoven web may contain about 25 grams of superabsorbent per 100 grams of pulp fiber web.

As previously noted, the total energy imparted by the jets of working fluid (i.e., water jet streams) which hydraulically needle the wet-laid web is generally much less than normally used in conventional hydraulic entanglement processes. The desired loosening of the fiber network occurs when the total energy imparted by the working fluid at the surface of the nonwoven web is from about 0.002 to about 0.03 horsepower-hours/pound of dry web. Because no fibrous substrates or staple length fibers are present in the wet-laid web during hydraulic needling, the fluid streams appear to provide little or no entanglement and actually tend to decrease the strength of the treated web when compared to the strength of its untreated counterpart as shown in Table 1.

Figure 2:
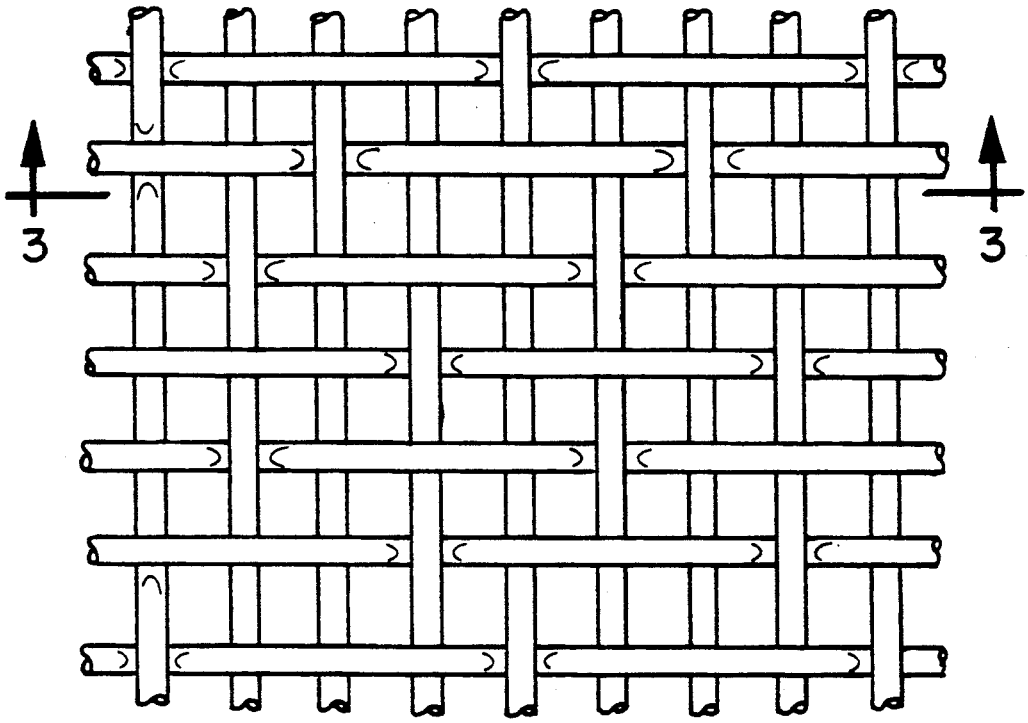
FIG. 2 is a plan view of an exemplary multi-ply mesh fabric suitable as a supporting surface for hydraulic needling of a nonwoven pulp fiber web.
Figure 3:
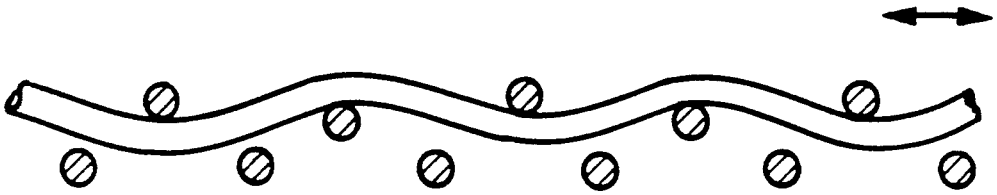
FIG. 3 is a sectional view taken along 3—3' of FIG. 2 showing one ply of an exemplary multi-ply mesh fabric.
Figure 4:
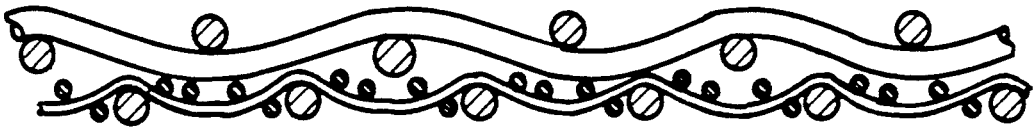
FIG. 4 is a sectional view taken on 3—3' of FIG. 2 showing two plies of an exemplary multi-ply mesh fabric.

FIG. 2 is a top view of an exemplary multi-ply mesh fabric used in making the absorbent nonwoven hydraulically needled wet-laid web of the present invention. In FIG. 2, line A—A' runs across the multi-ply mesh fabric in the cross-machine direction. The multi-ply (i.e., compound) fabric may include a coarse layer joined to fine layer. FIG. 3 illustrates a sectional view taken along line A—A' of a coarse layer 62 (a simple single layer weave) of the exemplary mesh fabric. FIG. 4 illustrates a sectional view taken along A—A' of a coarse layer 62 joined to a fine layer 64 (another simple single layer weave). Preferably the coarse layer 62 has a mesh (i.e., warp yarns of fabric per inch of width) of about 50 or less and a count (shute yarns of fabric per inch of length) of about 50 or less. For example, the coarse layer 62 may have a mesh of about 35 to 40 and a count of about 35 to 40. More particularly, the coarse layer 62 may have a mesh of about 38 and a count of about 38. The fine layer 64 preferably has a mesh and count about twice as great as the coarse layer 62. For example, the fine layer 64 may have a mesh of about 70 to about 100 and a count of about 70 to about 100. In particular, the fine layer 64 may have a mesh of about 70 to 80 and a count of about 70 to 80. More particularly, the fine layer may have a mesh of about 75 and a count of about 75.

Figure 5:
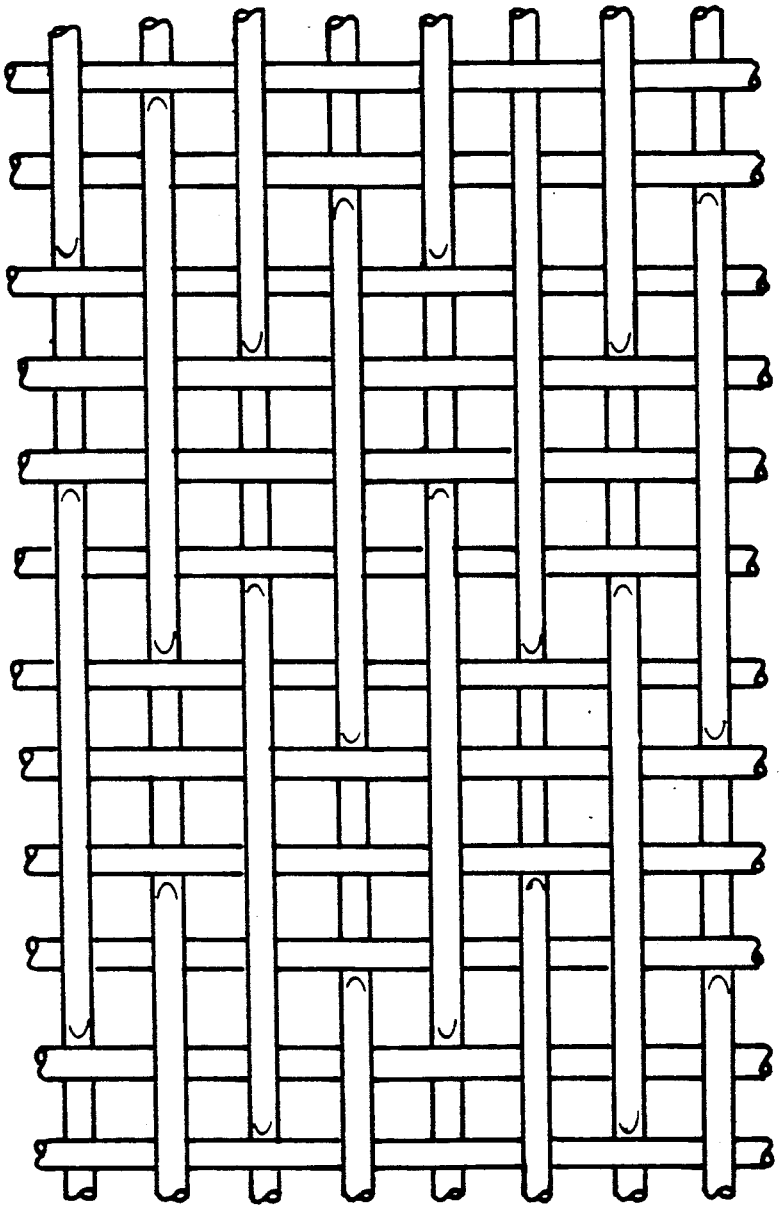
FIG. 5 is a bottom view of one ply of an exemplary multi-ply mesh fabric.
Figure 6:
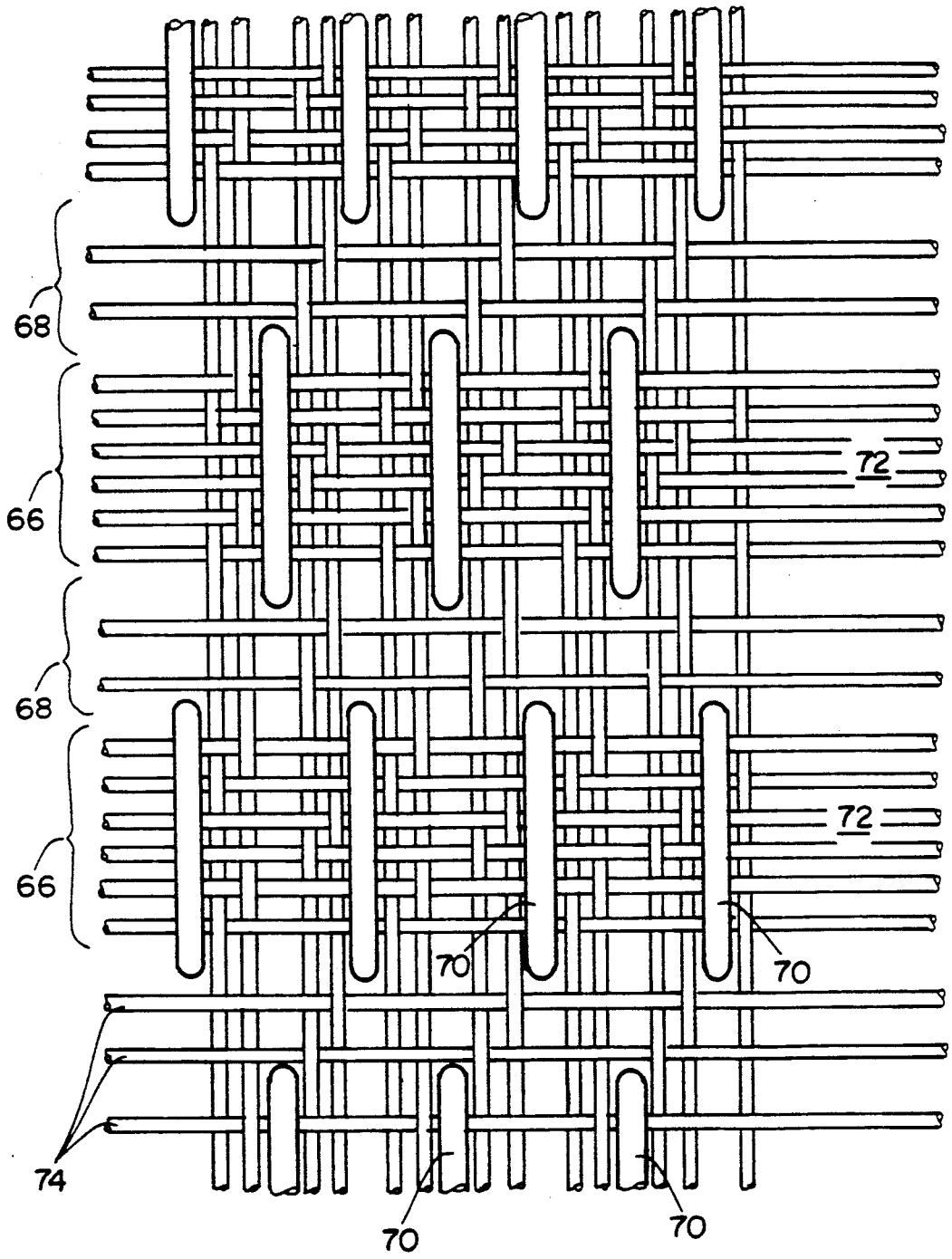
FIG. 6 is a bottom view of an exemplary multi-ply mesh fabric showing two plies of the fabric.

FIG. 5 is a bottom view of the coarse layer without the fine layer. FIG. 6 is a bottom view of the multi-ply mesh fabric showing the coarse layer interwoven with the fine layer illustrating a preferred weave construction. The particular weave provides cross-machine direction channels defining high drainage zones 66 which are separated by low drainage zones 68. The warp strands 70 of the coarse layer are arranged in rows 72 which define channels that run along the top of the fabric in the cross-machine direction. These warp strands 70 are woven to gather groups of filaments 74 (also running in cross-machine direction) of the fine layer. The rows 72 of warp strands 70 are matched with the groups of filament 74 to provide the low drainage zones 68 which separate the high drainage zones 68.

Figure 7:
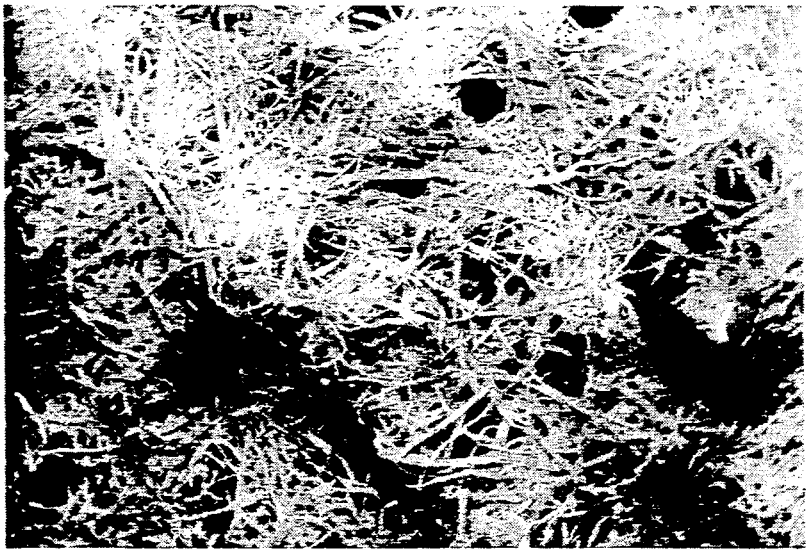
FIG. 7 is a photomicrograph of the surface of an exemplary wet-laid, hydraulically needled nonwoven pulp fiber web.

During the fluid-jet treatments, the pulp fibers generally conform to the topography of the coarse layer to provide a textile-like appearance. Flow of fluid through the fabric is controlled by the high drainage zones and the fine layer on the bottom of the fabric to provide the proper conditions for loosening/opening the pulp fiber network during hydraulic needling while avoiding web break-up, washout of short fibers and intertwining of fibers into the mesh fabric. In some embodiments, the weave patterns may have certain filaments (e.g., warp strands) which protrude to form knuckles. Pulp fibers may be washed off portions of these knuckles to form small pores or apertures. For example, FIG. 7 is a 20× photomicrograph of the surface of a wet-laid nonwoven web which was hydraulically needled on the fabric of FIGS. 2–6. As can be seen, the material has small pores or apertures. These small pores or apertures may range, for example, from about 200 to about 400 microns in diameter. The areas between the apertures or pores appears to contain low density deposits of fibers which correspond to channel-like portions of the foraminous surface.

The present invention may be practiced with other forming fabrics. In general, the forming fabric must be fine enough to avoid fiber washout and yet allow adequate drainage. For example, the nonwoven web may be wet laid and hydraulically needled on a conventional single plane mesh having a mesh size ranging from about 40×40 to about 100×100. The forming fabric may also be a multi-ply mesh having a mesh size from about 50×50 to about 200×200. Such a multi-ply mesh may be particularly useful when secondary fibers are incorporated into the nonwoven web. Useful forming fabrics include, for example, Asten-856, Asten 892, and Asten Synweve Design 274, forming fabrics available from Asten Forming Fabrics, Inc. of Appleton, Wisconsin.

Figure 8:
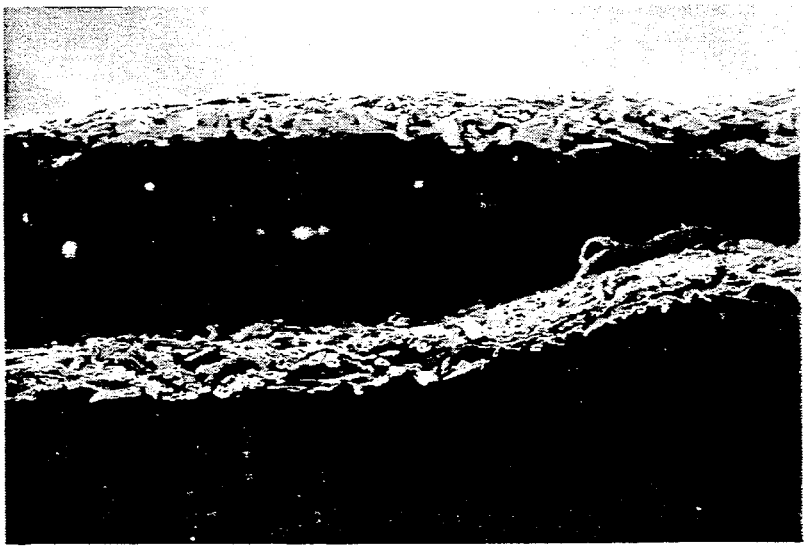
FIG. 8 is a photomicrograph of a cross-section of an exemplary two-ply paper towel.
Figure 9:
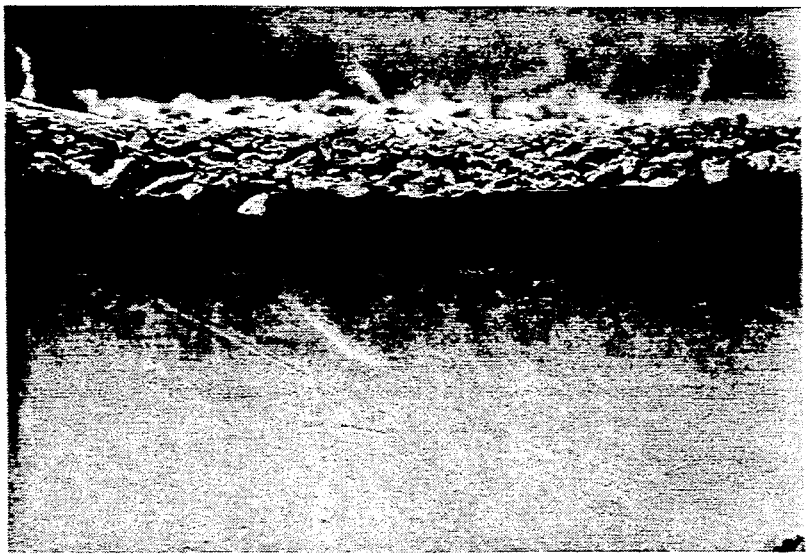
FIG. 9 is a photomicrograph of a cross-section of an exemplary un-embossed single-ply paper towel.

FIG. 8 is a 100× photomicrograph of a cross-section of an exemplary two-ply paper towel. As is evident from the photomicrograph, the apparent thickness of the two-ply paper towel is much greater than the combined thickness of each ply. Although multiple plies typically increase the absorbent capacity of a paper towel, multiple plies may increase the expense and difficulty of manufacture. FIG. 9 is a 100× photomicrograph of a cross-section of an exemplary unembossed single-ply paper towel. Although untreated or lightly treated paper towels are inexpensive to produce, they typically have a low total absorptive capacity. In some situations, the total absorptive capacity may be increased by increasing the basis weight of the paper towel, but this is undesirable since it also increases the cost.

Figure 10:
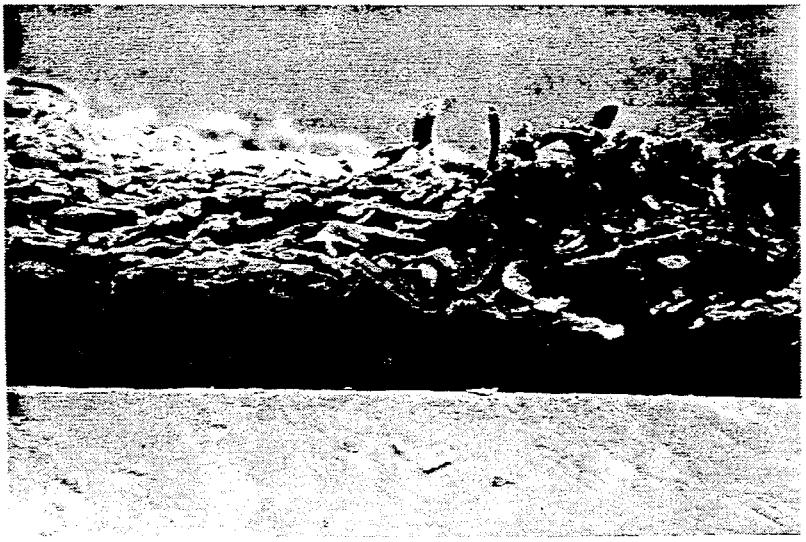
FIG. 10 is a photomicrograph of a cross-section of a flat portion of an exemplary single-ply embossed paper towel.
Figure 11:
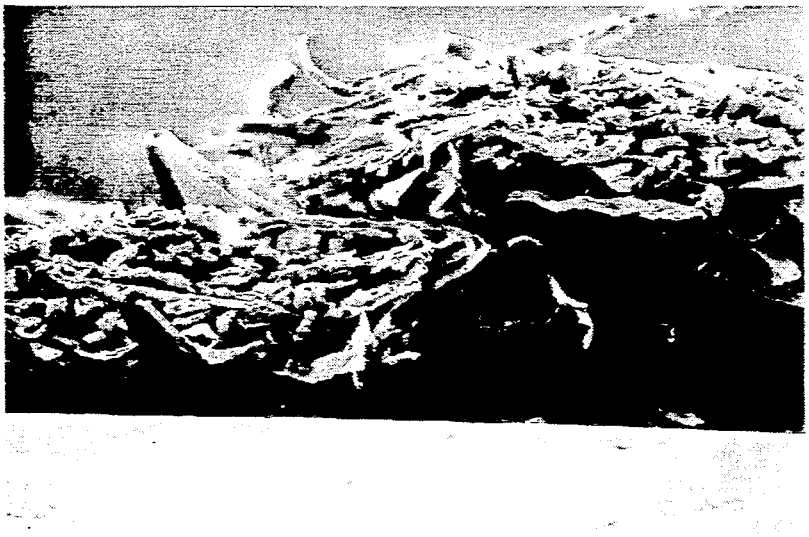
FIG. 11 is a photomicrograph of a cross-section of an embossed area of an exemplary single-ply embossed paper towel.
Figure 12:
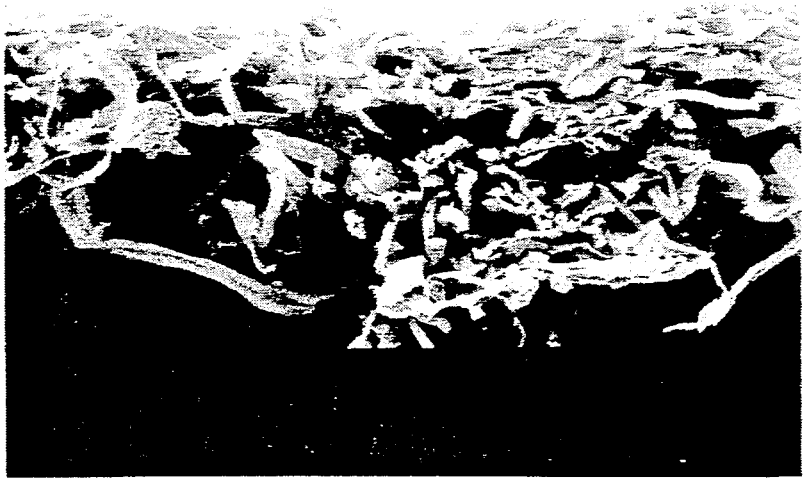
FIG. 12 is a photomicrograph of a cross section of an exemplary wet-laid hydraulically needled absorbent nonwoven pulp fiber web.
Figure 13:
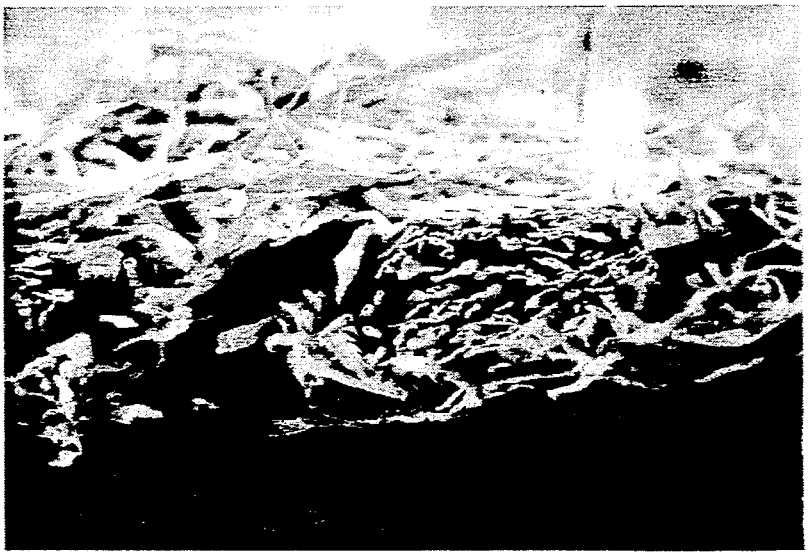
FIG. 13 is a photomicrograph of a cross section of an exemplary wet-laid hydraulically needled absorbent nonwoven pulp fiber web after a post-treatment step.

FIG. 10 is a 100× photomicrograph of a cross-section of a flat portion of an exemplary single-ply embossed paper towel. FIG. 11 is a 100× photomicrograph of a cross-section of an embossed area of the same single-ply embossed paper towel. Embossing increases the apparent thickness of the paper towel and appears to loosen up the fiber structure to improve absorbency. Although an embossed paper towel may have a greater apparent bulk than an unembossed paper towel, the actual thickness of most portions of an embossed paper towel is generally about the same as can be seen from FIGS. 10 and 11. While some embossed paper towels may have a total absorptive capacity greater than about 500 percent, it is believed that a more complete opening up of the pulp fiber structure would further increase the total absorptive capacity. Additionally, the embossed paper sheets generally have relatively low wicking rates (e.g., less than about 1.75 cm/15 seconds). FIG. 12 is a 100× photomicrograph of a cross section of an exemplary wet-laid hydraulically needled absorbent nonwoven web. FIG. 13 is a 100× photomicrograph of a cross-section of an exemplary wet-laid hydraulically needled absorbent nonwoven web after a post treatment with calender rollers to create a uniform surface appearance. As can be seen from FIGS. 12 and 13, the hydraulically needled nonwoven webs have a relatively loose fiber structure, uniform thickness and density gradient when compared to embossed paper towels. The hydraulically needled webs also appear to have more fibers with a Z-direction orientation than embossed and unembossed materials. Such an open and uniformly thick structure appears to improve the total absorptive capacity, water rate and wicking rate.

Figure 14:
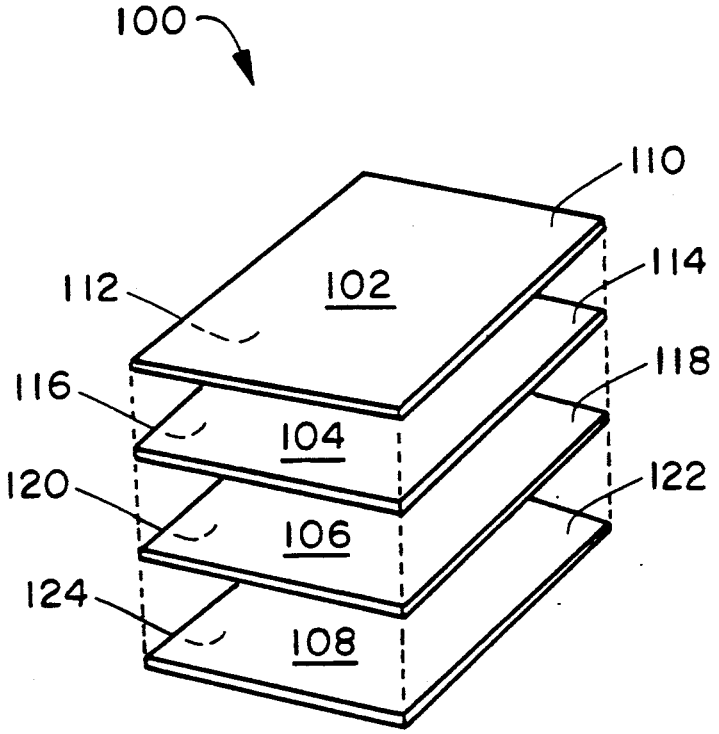
FIG. 14 is a representation of an exemplary absorbent structure that contains a wet-laid, hydraulically needled nonwoven pulp fiber web.

FIG. 14 is an exploded perspective view of an exemplary absorbent structure 100 which incorporates a hydraulically needled nonwoven pulp fiber web as a fluid distribution material. FIG. 14 merely shows the relationship between the layers of the exemplary absorbent structure and is not intended to limit in any way the various ways those layers (or other layers) may be configured in particular products. The exemplary absorbent structure 100, shown here as a multi-layer composite suitable for use in a disposable diaper, feminine pad or other personal care product contains four layers, a top layer 102, a fluid distribution layer 104, an absorbent layer 106, and a bottom layer 108. The top layer 102 may be a nonwoven web of melt-spun fibers or filaments, an apertured film or an embossed netting. The top layer 102 functions as a liner for a disposable diaper, or a cover layer for a feminine care pad or personal care product. The upper surface 110 of the top layer 102 is the portion of the absorbent structure 100 intended to contact the skin of a wearer. The lower surface 112 of the top layer 102 is superposed on the fluid distribution layer 104 which is a hydraulically needled nonwoven pulp fiber web. The fluid distribution layer 104 serves to rapidly desorb fluid from the top layer 102, distribute fluid throughout the fluid distribution layer 104, and release fluid to the absorbent layer 106. The fluid distribution layer has an upper surface 114 in contact with the lower surface 112 of the top layer 102. The fluid distribution layer 114 also has a lower surface 116 superposed on the upper surface 118 of an absorbent layer 106. The fluid distribution layer 114 may have a different size or shape than the absorbent layer 106. The absorbent layer 106 may be a layer of pulp fluff, superabsorbent material, or mixtures of the same. The absorbent layer 106 is superposed over a fluid-impervious bottom layer 108. The absorbent layer 106 has a lower surface 120 which is in contact with an upper surface 122 of the fluid impervious layer 108. The bottom surface 124 of the fluid-impervious layer 108 provides the outer surface for the absorbent structure 100. In more conventional terms, the liner layer 102 is a topsheet, the fluid-impervious bottom layer 108 is a backsheet, the fluid distribution layer 104 is a distribution layer, and the absorbent layer 106 is an absorbent core. Each layer may be separately formed and joined to the other layers in any conventional manner. The layers may be cut or shaped before or after assembly to provide a particular absorbent personal care product configuration.

When the layers are assembled to form a product such as, for example, a feminine pad, the fluid distribution layer 104 of the hydraulically needled nonwoven pulp fiber web provides the advantages of reducing fluid retention in the top layer, improving fluid transport away from the skin to the absorbent layer 106, increased separation between the moisture in the absorbent core 106 and the skin of a wearer, and more efficient use of the absorbent layer 106 by distributing fluid to a greater portion of the absorbent. These advantages are provided by the improved vertical wicking and water absorption properties.

EXAMPLES

The tensile strength and elongation measurements were made utilizing an Instron Model 1122 Universal Test Instrument in accordance with Method 5100 of Federal Test Method Standard No. 191A. Tensile strength refers to the maximum load or force encountered while elongating the sample to break. Measurements of Peak Load were made in the machine and cross-machine directions for both wet and dry samples. The results are expressed in units of force (grams$_f$) for samples that measured 3 inches wide by 6 inches long.

"Elongation" or "percent elongation" refers to a ratio determined by measuring the difference between a nonwoven web's initial unextended length and its extended length in a particular dimension and dividing that difference by the nonwoven webs initial unextended length in that same dimension. This value is multiplied by 100 percent when elongation is expressed as a percent. The elongation was measured when the material was stretched to about its breaking point.

The energy imparted to the nonwoven web by the hydraulic needling process may be expressed in units of horsepower-hours per pound of dry web (hp-hr/lb) and may be calculated utilizing the following equation:

$$\text{Energy}=0.125((Y*P*Q/(S*B))*N$$

where:

Y=number of orifices per linear inch of manifold;

P=pressure of the water in the manifold expressed in pounds per square inch gauge (psig);

Q=volumetric flow rate of water expressed in cubic feet per minute per orifice;

S=speed of conveyor passing the web under the water jet streams expressed in feet per minute;

L=weight of pulp fibers treated expressed in ounces per square yard;

N=number of manifold passes.

This energy equation may be found in U.S. Pat. No. 3,485,706, previously incorporated herein by reference, which discusses the transfer of energy from fluid jet streams to a nonwoven fibrous web.

Examples 1–6 illustrate exemplary hydraulically needled nonwoven pulp fiber webs. A portion of the wet-laid nonwoven pulp fiber webs prepared for Examples 1–6 was not hydraulically needled. Instead, that material was through-air dried and kept as a control material. The basis weight, tensile properties, total absorptive capacity, wicking rates, water rate, thickness, porosity specific volumes, and mean flow pore size for the hydraulically needled and control materials of Examples 1–8 were measured and are reported in Table 1. The measurements of the control materials are reported in Table 1 in the rows entitled "Control". The hydraulic needling energy of each sample was calculated and is reported in Table 1 under the column heading "Energy".

EXAMPLE 1

A mixture of 50% by weight northern softwood unrefined virgin wood fiber pulp (Longlac 19 available from the Kimberly-Clark Corporation) and 50% by weight secondary fiber pulp (BJ de-inked secondary fiber pulp available from the Ponderosa Pulp Products—a division of Ponderosa Fibers of America, Atlanta, Georgia) was wet-laid utilizing conventional papermaking techniques onto the multi-ply mesh fabric. This fabric is generally described in FIGS. 2–6 and contains a coarse layer having a mesh of 37 (number of filaments per inch running in the machine direction) and a count of 35 (number of filaments per inch running in the cross-machine direction) and a fine layer having a mesh of 74 and a count of 70. The wet-laid web was de-watered to a consistency of approximately 25 percent solids and was hydraulically needled with jets of water at about 110 psig from 3 manifolds each equipped with a jet strip having 0.007 inch diameter holes (1 row of holes at a density of 30 holes per inch). The discharge of the jet orifices was between about 2 cm to about 3 cm above the wet-laid web which travelled at a rate of about 50 feet per minute. Vacuum boxes removed excess water and the treated web was dried utilizing a rotary through-air dryer manufactured by Honeycomb Systems Incorporated of Biddeford, Maine.

EXAMPLE 2

A wet-laid hydraulically entangled nonwoven web was formed essentially as described in Example 1 except that the wood fiber pulp was all Northern softwood unrefined virgin wood fiber pulp (Longlac 19), 4 manifolds were used, and the web travelled at a rate of about 750 feet per minute. The nonwoven web was hydraulically entangled on a multi-ply mesh fabric generally described in FIGS. 2–6 and contains a mesh of 136 (filaments per inch—machine direction) and coarse layer of filaments having count of 30 (filaments per inch—cross-machine direction) and a fine layer having a count of 60.

EXAMPLE 3

A wet-laid hydraulically needled nonwoven web was formed essentially as described in Example 2 except that the pulp was a mixture of 75% by weight secondary fiber pulp (BJ de-inked secondary fiber pulp) and 25% by weight Northern softwood unrefined virgin wood pulp (Longlac 19). The nonwoven pulp fiber web was hydraulically entangled on the same multi-ply mesh described in Example 2.

EXAMPLE 4

A wet-laid hydraulically needled nonwoven web was formed essentially as described in Example 2 except that the wood fiber pulp was all lightly refined Northern softwood virgin wood fiber pulp (Longlac 19) instead of unrefined virgin wood fiber pulp.

EXAMPLE 5

A wet-laid hydraulically needled nonwoven web was formed from a mixture of 50% by weight Northern softwood unrefined virgin wood fiber pulp (Longlac 19) and 50% by weight secondary fiber pulp (BJ de-inked secondary fiber pulp) utilizing conventional papermaking techniques onto an Asten-856 forming fabric (Asten Forming Fabrics, Inc. of Appleton, Wisconsin). The wet-laid web was de-watered to a consistency of approximately 25 percent solids. Hydraulic needling was accomplished with jets of water at about 170 psig from 3 manifolds each equipped with a jet strip having 0.005 inch diameter holes (1 row of holes at a density of 40 holes per inch). The jet orifices were approximately 2 cm above the wet-laid web which travelled at a rate of about 750 feet per minute. Vacuum boxes removed excess water and the treated web was dried utilizing a through-air dryer.

EXAMPLE 6

A wet-laid hydraulically needled nonwoven web was formed essentially as described in Example 5 with certain changes. The wood fiber pulp was all unrefined virgin Southern softwood fiber pulp. The pulp fibers were wet-laid and hydraulically needled on an Asten-274 forming fabric (Asten Forming Fabrics, Inc. of Appleton, Wisconsin). Hydraulic needling took place at the same conditions as Example 5 except that the water pressure was 140 psig, the jet strip had 0.007 inch diameter holes (1 row of holes at a density of 30 holes per inch); the jet orifices were about 4 cm about the wet-laid nonwoven web and the web travelled at a rate of 50 feet per minute.

TABLE 1

| SAMPLE | Basis Weight (gsm) | (Tensile Properties) Peak Load MD (Dry) (g) | MD % Elong | Peak Load CD (Dry) (g) | CD % Elong | Total Absorptive Cap. (%) | Vertical Wicking MD | Vertical Wicking CD | Thickness (inch) | Specific Volume ($cm^3/g$) |
|---|---|---|---|---|---|---|---|---|---|---|
| Example 1 | | | | | | | | | | |
| Needled | 55.0 | 4094 | 2.1 | 1964 | 9.3 | 577 | 3.4 | 2.9 | 0.0218 | 10.07 |
| Control | 54.0 | 10250 | 1.7 | 6757 | 2.3 | 365 | 2 | 1.6 | 0.0125 | 5.88 |
| Example 2 | | | | | | | | | | |
| Needled | 44.4 | 3271 | 7.0 | 1085 | 7.7 | 634 | 3.4 | 3.0 | 0.026 | 14.87 |
| Control | 47.0 | 5792 | 5.0 | 3400 | 3.8 | 472 | 3.5 | 3.0 | 0.0813 | 9.89 |
| Example 3 | | | | | | | | | | |
| Needled | 48.4 | 4192 | 8.4 | 2050 | 9.4 | 540 | 3.0 | 2.8 | 0.029 | 15.22 |
| Control | 51.8 | 8949 | 6.8 | 5310 | 3.4 | 429 | 2.6 | 2.6 | 0.020 | 9.81 |
| Example 4 | | | | | | | | | | |
| Needled | 50.7 | 5084 | 8.0 | 1585 | 6.6 | 562 | 3.7 | 3.0 | 0.027 | 13.33 |
| Control | 40.3 | 8977 | 5.9 | 4730 | 3.07 | 460 | 3.2 | 2.9 | 0.018 | 9.77 |
| Example 5 | | | | | | | | | | |
| Needled | 47.0 | 6155 | 5.1 | 2844 | 3.4 | 473 | 2.62 | 2.3 | 0.019 | 10.05 |
| Control | 48.0 | 11910 | 3.3 | 6793 | 2.6 | 354 | 1.8 | 1.9 | 0.016 | 8.5 |
| Example 6 | | | | | | | | | | |
| Needled | 97.5 | 6898 | 1.9 | 4696 | 5.6 | 529 | 5.0 | 4.1 | 0.027 | 7.09 |
| Control | 94.3 | 18480 | 1.7 | 13990 | 2.3 | 353 | 4.2 | 4.1 | 0.024 | 6.38 |

| SAMPLE | Frazier Porosity ($cfm/ft^2$) | Mean Flow Pore Size (μm) | Water Rate (sec) | Energy hp-hr/lb |
|---|---|---|---|---|
| Example 1 | | | | |
| Needled | 227.5 | 69.5 | 0.8 | 0.0184 |
| Control | 23.7 | 20.0 | 4.1 | |
| Example 2 | | | | |
| Needled | 199.6 | 47.0 | 0.7 | 0.0020 |
| Control | 47.3 | 24.0 | 1.1 | |
| Example 3 | | | | |
| Needled | 195.2 | 51.3 | 0.9 | 0.0019 |
| Control | 36.96 | 21.7 | 3.2 | |
| Example 4 | | | | |
| Needled | 142.2 | 46.0 | 0.9 | 0.0017 |
| Control | 45.97 | 24.0 | 1.5 | |

TABLE 1-continued

| | | | | |
|---|---|---|---|---|
| Example 5 | | | | |
| Needled | 70.8 | 28.0 | 2.5 | 0.0020 |
| Control | 25.9 | 18.4 | 4.3 | |
| Example 6 | | | | |
| Needled | 79.5 | 29.2 | 0.8 | 0.0154 |
| Control | 20.1 | 18.8 | 1.2 | |

[1]cm/15 seconds

EXAMPLE 7

The hydraulically needled nonwoven web of Example 2 was measured for mean flow pore size, total absorptive capacity, Frazier porosity, thickness and basis weight. The same measurements were taken for a single-ply embossed hand towel available from Georgia Pacific Corporation under the trade designation Georgia-Pacific 551; a single ply embossed hand towel available from the Scott Paper Company under the trade designation Scott 180; and a single ply embossed SURPASS ® hand towel available from the Kimberly-Clark Corporation. The results of the measurements are given in Table 2.

TABLE 2

| | G-P 551 | SCOTT 180 | SURPASS ® | Example 2 |
|---|---|---|---|---|
| Mean Flow Pore Size (μm) | 11.9 | 15.4 | 18.8 | 47.0 |
| Total Absorptive Capacity (%) | 330 | 374 | 463 | 634 |
| Frazier Porosity (cfm/ft$^2$) | 14 | 24 | 38 | 200 |
| Thickness (inch) | 0.014 | 0.0071 | 0.0198 | 0.026 |
| Basis Weight (gsm) | 44 | 45 | 45 | 44 |

As can be seen in Table 2, it appears that the open or loose fiber structure of the material from Example 2 provides a large mean flow pore size, good porosity and bulk, and also provides greater total absorptive capacity.

EXAMPLE 8

The tensile properties and absorbency characteristics of the hydraulically needled nonwoven web of Example 2 were measured. The same measurements were taken for a single-ply embossed hand towel available from Georgia Pacific Corporation under the trade name Georgia-Pacific 553; a two-ply embossed hand towel available from the James River Corporation under the trade designation James River-825; single-ply embossed hand towels available from the Scott Paper Company under the trade designations Scott 150 and Scott 159; and a 100% de-inked secondary (recycled) fiber single-ply embossed hand towel available from the Fort Howard Company under the trade designation Fort Howard 244. The results of the measurements are shown in Table 3.

TABLE 3

| | Fort Howard 244 | Example 2 | Scott 159 | Scott 150 | James River 825 | Georgia Pacific 533 |
|---|---|---|---|---|---|---|
| Basis Wt. (gsm) | 51 | 44 | 58 | 51 | 49 | 46 |
| Tensile Strength | | | | | | |
| Peak Load | | | | | | |
| MD-Dry (g) | 7554 | 3271 | 3830 | 4820 | 7950 | 5030 |
| MD-Wet (g) | 1008 | — | 1150 | 1020 | 1365 | 845 |
| CD-Dry (g) | 3043 | 1085 | 1745 | 1860 | 3590 | 1240 |
| CD-Wet (g) | 450 | — | 605 | 490 | 795 | 280 |
| Elongation | | | | | | |
| MD (%) | 6.2 | 7.0 | 7.4 | 5.5 | 5.9 | 5.3 |
| CD (%) | 4.8 | 7.7 | 11.3 | 9.0 | 2.9 | 9.6 |
| Thickness, inch | 0.0113 | 0.026 | 0.022 | 0.019 | 0.014 | 0.015 |
| Absorptive Capacity (%) | 284 | 634 | 550 | 540 | 455 | 390 |
| Water Rate (sec.) | 48.6 | 0.7 | 5.0 | 4.1 | 14.1 | 25 |
| Wicking Rate (cm/15 sec.) | | | | | | |
| MD | 0.88 | 3.0 | 1.5 | 1.6 | 1.2 | 1.2 |
| CD | 0.98 | 3.0 | 1.6 | 1.6 | 1.3 | 1.1 |
| Frazier Porosity (cfm) | 4.0 | 200 | 37.1 | 41.2 | 15.8 | 19.1 |

EXAMPLE 9

An absorbent structure having a wettable fibrous cover was made utilizing a top layer of approximately 24 gsm thermally bonded carded web of 2.2 decitex 50 mm polypropylene staple fibers finished with a 0.4% Silastol GF 602 wettable lubricant available from Schill & Seibacher, Boblingen, Federal Republic of Germany; an intermediate layer of an absorbent, wet-laid, hydraulically needled nonwoven pulp fiber web having a basis weight of about 45 gsm; and an absorbent core of an approximately 60 gsm batt of Southern softwood wood pulp fluff (pulp fluff #54 available from Kimberly-Clark Corporation's Coosa River plant). Each layer measured about 1.25 inches by 4.5 inches. The layers were assembled into an absorbent structure that was held together in the test apparatus described below.

Another structure was made from the same cover material and absorbent core but contained an intermediate layer of a 60 gsm nonwoven web of meltblown polypropylene fibers.

The structures were tested to determine how quickly the structures absorbed an artificial menstrual fluid obtained from the Kimberly-Clark Corporation's Analytical Laboratory, Neenah, Wisconsin. This fluid had a viscosity of about 17 centipoise at room temperature (about 73° F.) and a surface tension of about 53 dynes/-centimeter.

Figure 15:
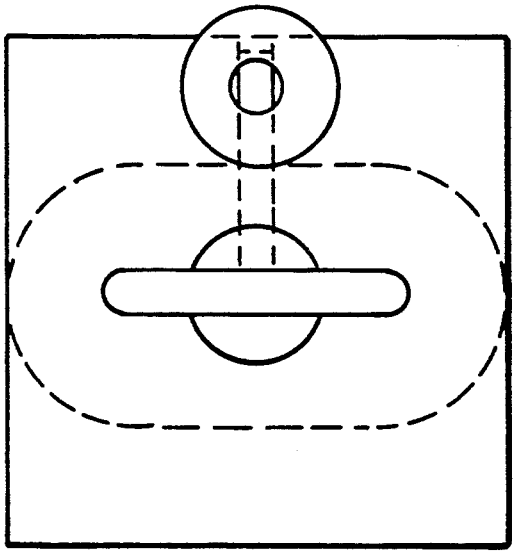
FIG. 15 is a top view of a test apparatus for measuring the rate which an absorbent structure absorbs a liquid.
Figure 16:
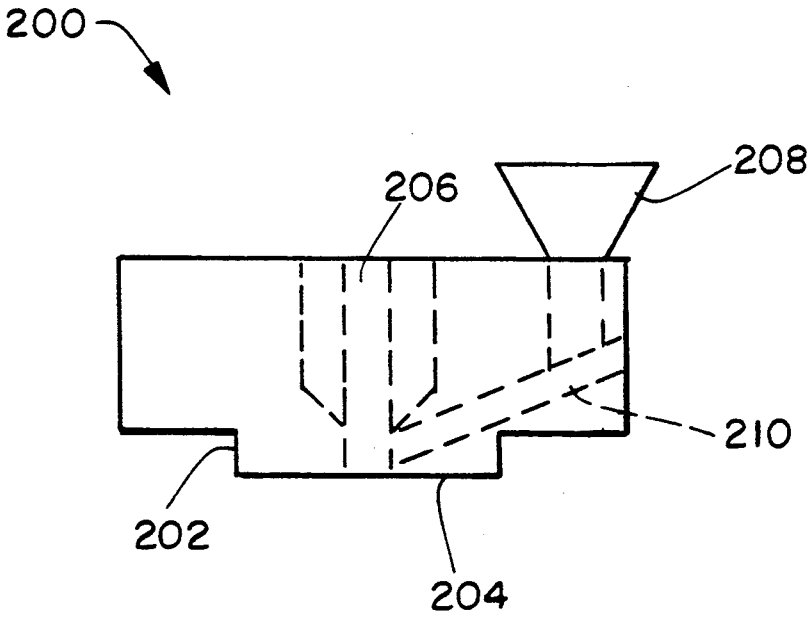
FIG. 16 is a cross-sectional view of a test apparatus for measuring the rate at which an absorbent structure absorbs a liquid.

The test apparatus consisted of 1) a Lucite®block and 2) a flat, horizontal test surface. FIGS. 15 is a plan view of the Lucite® block. FIG. 16 is a sectional view of the Lucite® block. The block 200 has a base 202 which protrudes from the bottom of the block. The base 202 has a flat surface 204 which is approximately 2.875 inches long by 1.5 inches wide that forms the bottom of the block 200. An oblong opening 206 (about 1.5 inches long by about 0.25 inch wide) is located in the center of the block and extends from the top of the block to the base 202 of the block. When the bottom of the opening 206 is obstructed, the opening 206 can hold more than about 10 cmhu 3 of fluid. A mark on the opening 206 indicates a liquid level of about 2 $cm^3$. A funnel 208 on the top of the block feeds into a passage 210 which is connected to the oblong opening 206. Fluid poured down the funnel 208 passes through the passage 210 into the oblong opening 206 and out onto a test sample underneath the block.

Each sample was tested by placing it on a flat, horizontal test surface and then putting the flat, projecting base of the block on top of the sample so that the long dimension of the oblong opening was parallel to the long dimension of the sample and centered between the ends and sides of the sample. The weight of the block was adjusted to about 162 grams so that the block rested on the structure with a pressure of about 7 grams/$cm_2$ (about 1 psi). A stopwatch was started as approximately ten (10) $cm^3$ of the fluid was dispensed into the funnel from a Repipet (catalog No. 13-687-20; Fischer Scientific Company). The fluid filled the oblong opening of the block and the watch was stopped when the meniscus of the fluid reached the 2 $cm^3$ level indicating that 8 $cm^3$ of fluid was absorbed. The results of this test are reported in Table 4.

TABLE 4

| Intermediate Layer | 8 $cm^3$ Time (sec) |
|---|---|
| 45 gsm absorbent nonwoven web | 13.77 |
| 60 gsm meltblown polypropylene | 27.63 |

EXAMPLE 10

An absorbent structure having an embossed net cover was made utilizing top layer of an embossed netting having a basis weight of about 45 gsm and an open area of about 35 to about 40%; an intermediate layer of an absorbent, wet-laid, hydraulically needled nonwoven pulp fiber web having a basis weight of about 45 gsm; and an absorbent core of an approximately 760 gsm batt of Southern softwood wood pulp fluff (pulp fluff #54 from Kimberly-Clark Corporation's Coosa River plant). Each layer each about 1.25 inches by 4.5 inches as in Example 11.

Two other absorbent structures were made from the same cover material and absorbent core but with a different intermediate layer. One structure had an intermediate layer of a 64 gsm nonwoven web of meltblown polypropylene fibers having an average fiber diameter of about 5–7 microns. The other had an intermediate layer of a 60 gsm nonwoven web of meltblown polypropylene fibers having an average fiber diameter of about 7–9 microns The absorbent structures were tested as previously described to determine how quickly each absorbed 8 $cm^3$ of an artificial menstrual fluid. The results are reported in Table 5.

TABLE 5

| Intermediate Layer | 8 $cm^3$ Time (sec) |
|---|---|
| 45 gsm absorbent nonwoven web | 5.0 |
| 60 gsm meltblown polypropylene (7–9 micron) | 7.0 |
| 60 gsm meltblown polypropylene (5–7 micron) | 11.0 |

As can be seen from Tables 4 and 5, the absorbent structures containing the 45 gsm absorbent nonwoven web of the present invention were able to absorb the test fluid faster than the absorbent structures containing the meltblown polypropylene fluid distribution layer.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A hydraulically needled nonwoven wet laid fibrous web wherein the fibrous material of the web consists essentially of pulp, said nonwoven web having a mean flow pore size ranging from about 18 to about 100 microns and a Frazier porosity of at least about 100 cfm/$ft^2$.

2. The nonwoven fibrous web of claim 1 wherein the web has a specific volume ranging from about 8 to about 15 cm $^3$g.

3. The nonwoven fibrous web of claim 1 wherein the web has a total absorptive capacity greater than about 500 percent and a wicking rate greater than about 2 cm per 15 seconds.

4. The nonwoven fibrous web of claim 1 wherein the pulp is a high-average fiber length pulp.

5. The nonwoven fibrous web of claim 4 wherein the pulp has an average fiber length from about 2 to about 5 mm.

6. The nonwoven fibrous web of claim 1 wherein the pulp comprises more than about 50% by weight, low-average fiber length pulp and less than about 50% by weight, high-average fiber length pulp.

7. The nonwoven fibrous web of claim 6 wherein the low-average fiber length pulp has an average length from about 0.8 mm to about 1.1 mm.

8. The nonwoven fibrous web of claim 4 wherein the high-average fiber length pulp is a wood pulp selected from bleached virgin softwood fiber pulp and unbleached virgin softwood fiber pulp.

9. The nonwoven fibrous web of claim 1 wherein the mean flow pore size is from about 20 to about 40 microns.

10. The nonwoven fibrous web of claim 3 wherein the nonwoven web has a total absorptive capacity between about 500 and about 750 percent.

11. The nonwoven fibrous web of claim 3 wherein the nonwoven web has a wicking rate from about 2 to about 3 cm per 15 seconds.

12. The nonwoven fibrous web of claim 1 wherein the nonwoven web has a frazier porosity from about 150 to about 200 cfm/ft$^2$.

13. The nonwoven fibrous web of claim 1 wherein the nonwoven web further comprises particulates selected from the group consisting of activated charcoal, clay, starch, and hydrocolloid materials commonly referred to as superabsorbent materials.

14. An absorbent paper towel comprising the nonwoven fibrous web of claim 1 having a basis weight ranging from about 18 to about 120 grams pr square meter.

15. An absorbent paper towel according to claim 14 wherein the nonwoven fibrous web has a basis weight ranging from about 30 to about 75 grams per square meter.

16. A fluid distribution component of an absorbent personal care product, said component comprising the nonwoven fibrous web of claim 1 having a basis weight ranging from about 7 to about 70 grams per square meter.

17. The fluid distribution component of an absorbent personal care product according to claim 16, wherein said component has a basis weight ranging from about 25 to about 50 grams per square meter.

18. A hydraulically needled nonwoven wet laid fibrous web wherein the fibrous material of the web consists essentially of pulp, said web having a mean flow pore size ranging from about 18 to about 100 microns and a Frazier porosity of at least about 100 cfm/ft$^2$, said pulp comprising:

at least about 50%, by weight, pulp having an average fiber length from about 0.7 to 1.2 mm; and less than about 50%, by weight, pulp having an average fiber length from about 1.5 to about 6 mm.

19. The nonwoven fibrous web of claim 18 wherein the web has a specific volume ranging from about 8 to about 15 cm$^3$/g.

20. The nonwoven fibrous web of claim 18 wherein the web has a total absorptive capacity greater than about 500 percent and a wicking rate greater than about 2 cm per 15 second.

21. The nonwoven fibrous web of claim 18 wherein the mean flow pore size ranges from about 20 to about 40 microns.

22. The nonwoven fibrous web of claim 20 wherein the nonwoven web has a total absorptive capacity between about 500 and about 750 percent.

23. The nonwoven fibrous web of claim 20 wherein the nonwoven web has a wicking rate between about 2 to about 3 cm per 15 seconds.

24. The nonwoven fibrous web of claim 18 wherein the nonwoven web has a Frazier porosity between about 150 and 250 cfm/ft$^2$.

25. The nonwoven fibrous web of claim 18 wherein the nonwoven web further comprises particulates selected from the group consisting of activate charcoal, clays, starches, and hydrocolloid materials commonly referred to as superabsorbent materials.

26. An absorbent paper towel comprising the nonwoven fibrous web of claim 18 having a basis weight ranging from about 18 to about 120 grams per square meter.

27. A fluid distribution component of an absorbent personal care product, said component comprising the nonwoven fibrous web of claim 18 having a basis weight ranging from about 7 to about 70 grams per square meter.

28. A method of making a hydraulically needled nonwoven fibrous web herein the fibrous material of the web consists essentially of pulp, said web having a mean flow pore size ranging from about 18 to about 100 microns and a Frazier porosity of at least about 100 cfm/ft$^2$, said method comprising the steps of:

forming a wet-laid nonwoven web from an aqueous dispersion of pulp fibers;

hydraulically needling the wet-laid nonwoven web on a foraminous surface at an energy level of about 0.03 to about 0.002 horsepower-hours/pound of dry web; and drying the wet-laid, hydraulically needled nonwoven web.

29. The method of claim 28 wherein the foraminous surface is a single plane mesh having a mesh size of from about 40×40 to about 100×100.

30. The method of claim 28 wherein the foraminous surface is selected from multi-ply meshes having an effective mesh size of from about 50×50 to about 200×200.

31. The method of claim 28 wherein the drying step utilized a process selected from the group consisting of through-air-drying, infra red radiation, yankee dryers, steam cans, microwaves, and ultrasonic energy.

32. The method of claim 28 wherein the wet-laid nonwoven web is hydraulically needled while at a consistency of about 25 to about 35 percent, by weight, solids.

33. The method of claim 28 wherein the aqueous dispersion of pulp fibers comprises more than about 50%, by weight, low-average fiber length pulp and less than about 50%, by weight, high-average fiber length pulp.

* * * * *

UNITED STATES PATENT AND TRADEMARK OFFICE

CERTIFICATE OF CORRECTION

PATENT NO. : 5,137,600

DATED : August 11, 1992

INVENTOR(S) : H. K. Barnes et al.

It is certified that error appears in the above-identified patent and that said Letters Patent is hereby corrected as shown below:

Column 4, line 52, "techniques" should read --technique--;

Column 18, line 61, "60 gsm" should read --760 gsm--;

Column 19, line 11, "FIGS. 15" should read --FIG. 15--;

Column 19, line 22, "10 cmhu 3" should read --10 $cm^3$--;

Column 19, line 67, "Each layer each" should read --Each layer measured--;

Column 20, line 9, "microns The" should read --microns. The--;

Column 22, line 12, "activate" should read --activated--;

Column 22, line 24, "herein" should read --wherein--.

Signed and Sealed this

Fourth Day of January, 1994

Bruce Lehman

*Attest:*

BRUCE LEHMAN

*Attesting Officer*

*Commissioner of Patents and Trademarks*